United States Patent [19]

Shimizu et al.

[11] Patent Number: 4,771,033

[45] Date of Patent: Sep. 13, 1988

[54] HEAT-SENSITIVE RECORD MATERIAL

[75] Inventors: Yoshihiro Shimizu, Amagasaki; Naoto Arai, Ikeda, both of Japan

[73] Assignee: Kanzaki Paper Manufacturing Co., Ltd., Tokyo, Japan

[21] Appl. No.: 70,067

[22] Filed: Jul. 6, 1987

[30] Foreign Application Priority Data

Jul. 10, 1986 [JP] Japan ..... 61-162606

[51] Int. Cl.[4] ..... B41M 5/00

[52] U.S. Cl. ..... 503/209; 427/150; 427/152; 428/913; 503/208; 503/225; 503/226

[58] Field of Search ..... 427/150–152; 428/913; 503/200, 208–212, 216, 225, 226

[56] References Cited

U.S. PATENT DOCUMENTS

| | | | |
|---|---|---|---|
| 4,473,831 | 9/1984 | Watanabe | 503/209 |
| 4,498,091 | 2/1985 | Yamato et al. | 503/225 |
| 4,628,335 | 12/1986 | Igarashi et al. | 503/209 |
| 4,630,080 | 12/1986 | Satake | 503/209 |

FOREIGN PATENT DOCUMENTS

| | | | |
|---|---|---|---|
| 0137773 | 6/1986 | Japan | 503/209 |

*Primary Examiner*—Bruce H. Hess

*Attorney, Agent, or Firm*—Morgan & Finnegan

[57] ABSTRACT

A heat-sensitive record material having on a base sheet a recording layer which comprises a basic colorless chromogenic material and an acceptor in the state of that the colorless chromogenic material is contacted with the acceptor by heating to produce color images. The recording layer comprises at least one phenol compound represented by the following formula (I) together with the colorless chromogenic material and the acceptor,

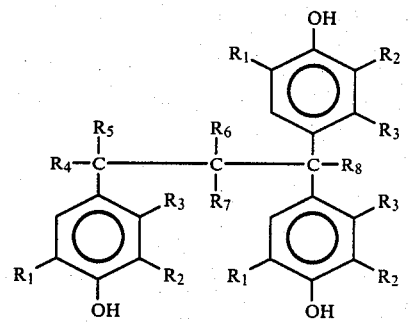

(I)

wherein each of $R_1$, $R_2$ and $R_3$ radicals is hydrogen, $C_{1-8}$ alkyl or $C_{5-8}$ cycloalkyl, but at least one of $R_1$, $R_2$ and $R_3$ radicals is $C_{5-8}$ cycloalkyl; and each of $R_4$, $R_5$, $R_6$, $R_7$ and $R_8$ radicals is hydrogen or $C_{1-8}$ alkyl.

11 Claims, No Drawings

HEAT-SENSITIVE RECORD MATERIAL

BACKGROUND OF THE INVENTION

This invention relates to a heat-sensitive record material and particularly to a heat-sensitive record material which is superior in adaptability to high speed recording and retainability of the recorded images.

There are known heat-sensitive record materials utilizing the colorforming reaction between a basic colorless chromogenic material and an electron accepting acidic reactant material (hereinafter referred to as "acceptor"), in which color images are produced by heating to contact with each other of the basic colorless chromogenic material and the acceptor. Since the heat-sensitive record materials are relatively economical and the recording machine is compact and relatively easily maintained, they are useful as a recording medium for various field, such as facsimiles, electronic computers and telex machines.

As the applied fields are broader, the required properties are increased. Recently, the heat-sensitive record materials are required not only to be superior in adaptability to high speed recording but also to be superior in stability of the recorded images at high temperature and high humidity and fogging-free in the white area (non-recorded area) at high temperature and high humidity.

There are proposed heat-sensitive record materials comprising various additive to improve the retainability of the recorded images. However, since a sufficient improvement is not obtained or a new problem occurs with the improvement, the desired results can not be always obtained.

For example, U.S. Pat. No. 4,473,831 discloses 1,1,3-tris(2-methyl-4-hydroxy-5-tert-butylphenyl)butane as such additive. However, using the additive, heat-sensitive record materials in which the white area is stably maintained to be fogging-free at high temperature can not be obtained.

The object of the invention is to provide heat-sensitive record materials superior in not only adaptability to high speed recording but also stability of the recorded images at high temperature and high humidity and further in which the white area is maintained to be fogging-free at high temperature and high humidity.

SUMMARY OF THE INVENTION

The heat-sensitive record materials according to the invention have on a base sheet a recording layer which comprises a basic colorless chromogenic material and an acceptor in the state of that they are contacted by heating to produce color images. The recording layer comprises at least one phenol compound represented by the following formula (I) together with the chromogenic material and the acceptor;

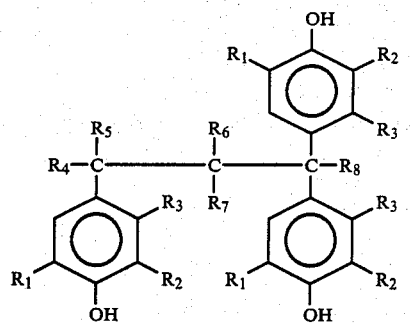

(I)

wherein each of $R_1$, $R_2$ and $R_3$ radicals in hydrogen, $C_{1-8}$ alkyl or $C_{5-8}$ cycloalkyl, at least one of $R_1$, $R_2$ and $R_3$ radicals is $C_{5-8}$ cycloalkyl; and each of $R_4$, $R_5$, $R_6$, $R_7$ and $R_8$ radicals is hydrogen atom or $C_{1-8}$ alkyl.

DETAILED DESCRIPTION OF THE INVENTION

Among the compounds represented by the formula (I), there are included 1,1,3-tris(2-methyl-4-hydroxy-5-cyclohexylphenyl)butane, 1,1,3-tris(2-ethyl-4-hydroxy-5-cyclohexylphenyl)butane, 1,1,3-tris(2-methyl-4-hydroxy-5-cyclohexylphenyl)propane, 1,1,3-tris(2-methyl-4-hydroxy-5-cyclopentylphenyl)butane, 1,1,3-tris(2-ethyl-4-hydroxy-5-cyclopentylphenyl)butane, 1,1,3-tris(2-methyl-4-hydroxy-5-cyclopentylphenyl)-propane and the like.

As the chromogenic materials comprised in the record layer according to the present invention, there are exemplified triarylmethanelactone compounds such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide and the like; diphenylmethane compounds such as 4,4'-bis-dimethylaminobenzhydryl benzyl ether, N-halophenyl-leucoauramine, N-2,4,5-trichlorophenyl-leucoauramine and the like; thiazine compounds such as benzoyl-leucomethylene blue, p-nitrobenzoyl-leucomethylene blue and the like; spiro compounds such as 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, 3-propyl-spiro-dibenzopyran and the like; lactam compounds such as Rhodamine-B anilinolactam, Rhodamine(p-nitroanilino)lactam, Rhodamine(o-chloroanilino)lactam and the like; and fluoran compounds such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-di-n-butylamino-6-methyl-7-phenylaminofluoran, 3-diethylamino-7-(2-carbomethoxy-phenylamino)fluoran, 3-(N-cyclohexyl-N-methylamino)-6-methyl-7-phenylaminofluoran, 3-(N-cyclopentyl-N-methylamino)-6-methyl-7-phenylaminofluoran, 3-(N-cyclopentyl-N-ethylamino)-6-methyl-7-phenylaminofluoran, 3-(N-cyclohexyl-N-ethylamino)-6-methyl-7-phenylaminofluoran, 3-(N-cyclohexylmethyl-N-methylamino)-6-methyl-7-phenylaminofluoran, 3-(N-3',3',5'-trimethylcyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-diethylamino-7-(o-fluorophenylamino)fluoran, 3-dibutylamino-7-(o-fluorophenylamino)fluoran, 3-(N-methyl-N-n-amyl)amino-6-methyl-7-phenylaminofluoran, 3-(N-ethyl-N-n-amyl-)amino-6-methyl-7-phenylaminofluoran, 3-(N-ethyl-N-isoamyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-$\beta$-ethylhexyl-)amino-6-methyl-7-phenylaminofluoran, 3-N-ethyl-N-tetrahydrofurfurylamino)-6-methyl-7-phenylfluoran and the like. Particularly, 3-dibutylamino-7-(o-chlorophenylamino)fluoran, 3-diethylamino-7-(o-chlorophenylamino)fluoran, 3-(N-ethyl-p-toluidino)-6-methyl-7-phenylaminofluoran are preferably used. In heat-sensitive record materials prepared by using those chromogenic materials, very superior advantages of the present invention can be obtained. The chromogenic materials may be used either solely or in combination.

Among the acceptors, there are many acidic compounds which develop a color by contacting with the above chromogenic materials, for example, phenolic compounds such as 4-tert-butylphenol, $\alpha$-naphthol, $\beta$-naphthol, 4-acetylphenol, 4-phenylphenol, hydroquinone, 4,4'-isopropylidenediphenol(bisphenol A), 2,2'-methylenebis(4-chlorophenol), 4,4'-cyclohexylidenediphenol, 4,4'-dihydroxydiphenylsulfide, hydroquinone monobenzyl ether, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenetyl 4-hydroxybenzoate, p-chlorobenzyl 4-hydroxybenzoate, p-methoxybenzyl 4-hydroxybenzoate, novolak phenol resin, phenol polymers and the like; aromatic carboxylic acids such as benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-($\alpha$-methylbenzyl)salicylic acid, 3-chloro-5-($\alpha$-methylbenzyl)salicylic acid, 3,5-di-tert-butylsalicylic acid, 3-phenyl-5-($\alpha,\alpha$-dimethylbenzyl)-salicylic acid, 3,5-di($\alpha$-methylbenzyl)salicylic acid and the like; and salts of the above phenolic compounds or aromatic carboxylic acids with polyvalent metals such as zinc, magnesium, aluminium, calcium, titanium, manganese, tin and nickel.

As the acceptors preferably used in the present invention, there are 4-hydroxydiphenylsulfone derivatives represented by the formula (II),

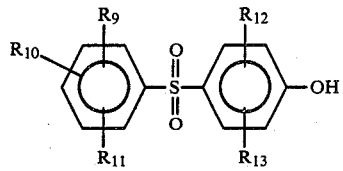

(II)

wherein each of $R_9$, $R_{10}$, $R_{11}$, $R_{12}$ and $R_{13}$ radicals is hydrogen, halogen, $C_{1-10}$ saturated or unsaturated alkyl, $C_{1-10}$ alkoxyl, benzyloxy, aryloxy or hydroxyl; $R_9$ and $R_{10}$ or $R_{10}$ and $R_{11}$ may form trimethylene or tetramethylene;

4-hydroxybenzenesulfonylnaphthalene derivatives represented by the formula (III) or (IV),

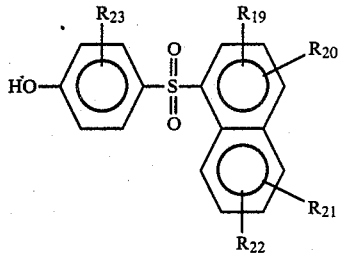

(III)

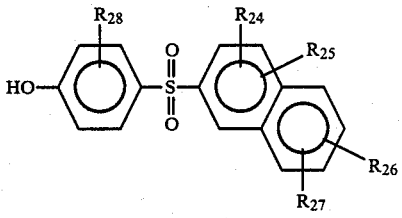

(IV)

wherein each of $R_{19}$ to $R_{28}$ radicals is hydrogen, halogen, $C_{1-10}$ saturated alkyl, $C_{1-10}$ alkoxyl, benzyloxy, aryloxy or hydroxy; and polyvalent metal salt of halophthalic acid monoesters represented by the formula (V),

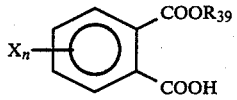

(V)

wherein $R_{39}$ radical is substituted or unsubstituted $C_{1-18}$ saturated alkyl, substituted or unsubstituted $C_{5-6}$ cycloalkyl, substituted or unsubstituted $C_{3-9}$ unsaturated alkyl, substituted or unsubstituted aryl, or substituted or unsubstituted aralkyl; X is halogen; and n is an integer of 1 to 4.

Among 4-hydroxydiphenylsulfone derivatives represented by the formula (II), there are included such as 4,4'-dihydroxydiphenylsulfone, 3,3'-dipropenyl-4,4'-dihydroxydiphenylsulfone, 4-hydroxy-4'-chlorodiphenylsulfone, 4-hydroxy-4'-methyldiphenylsulfone, 4-hydroxy-3',4'-dimethyldiphenylsulfone, 4-hydroxy-4'-ethyldiphenylsulfone, 4-hydroxy-4'-tert-butyldiphenylsulfone, 4-hydroxy-4'-n-octyldiphenylsulfone, 4-hydroxy-4'-methoxydiphenylsulfone, 4-hydroxy-4'-ethoxydiphenylsulfone, 4-hydroxy-4'-isopropyloxydiphenylsulfone, 4-hydroxy-4'-n-butoxy-diphenylsulfone, 4-hydroxy-4'-tert-butoxydiphenylsulfone, 4-hydroxy-4'-isoamyloxydiphenylsulfone, 4-hydroxy-4'-n-octyloxydiphenylsulfone, 4-hydroxy-4'-benzyloxydiphenylsulfone, 4-hydroxy-4'-phenoxydiphenylsulfone, 3',4'-trimethylene-4-hydroxydiphenylsulfone, 3',4'-trimethylene-2,6-dimethyl-4-hydroxydiphenylsulfone, 3',4'-tetramethylene-4-hydroxydiphenylsulfone, 3',4'-tetramethylene-2-methyl-4-hydroxydiphenylsulfone and the like.

Among 4-hydroxybenzenesulfonylnaphthalenes represented by the formula (III) or (IV), there are included 1-(4-hydroxybenzenesulfonyl)naphthalene, 1-(4-hydroxybenzenesulfonyl)-4-methylnaphthalene, 1-(4-hydroxybenzenesulfonyl)-4-methoxynaphthalene, 1-(4-hydroxybenzenesulfonyl)-4-chloronaphthalene, 1-(4-hydroxy-2-methylbenzenesulfonyl)naphthalene, 1-(4-hydroxy-2-chlorobenzenesulfonyl)naphthalene, 1-(4-hydroxybenzenesulfonyl)-2,3-dimethylnaphthalene, 1-(4-hydroxybenzenesulfonyl)-4-hydroxynaphthalene, 1-(4-hydroxybenzenesulfonyl)-2-hydroxynaphthalene, 1-(4-hydroxy-2-isopropylbenzenesulfonyl)naphthalene, 1-(4-hydroxy-2-isoamylbenzenesulfonyl)naphthalene, 1-(4-hydroxy-2-isopropyloxybenzenesulfonyl)naphthalene, 1-(4-hydroxybenzenesulfonyl)-4-tert-butoxynaphthalene, 1-(4-hydroxy-2-benzyloxybenzenesulfonyl)-naphthalene, 1-(4-hydroxy-2-phenoxybenzenesulfonyl)-naphthalene, 2-(4-hydroxybenzenesulfonyl)naphthalene and the like.

Among halophthalic acid monoesters represented by the formula (V), there are included monomethyl ester, monoethyl ester, monopropyl ester, monobutyl ester, monopentyl ester, monostearyl ester, monocyclohexyl ester, monocyclopentyl ester, monallyl ester, monobenzyl ester, mono-p-methylbenzyl ester, mono-p-chlorobenzyl ester, monophenethyl ester, monophenyl ester, mono-p-methylphenyl ester, mono-2,4-dimethylphenyl ester, mono-p-chlorophenyl ester, mono-p-ethoxyphenyl ester, mono-1-naphthyl ester, mono-2-naphthyl ester, mono-2-hydroxyethyl ester, mono-2-hydroxybutyl ester, mono-3-hydroxybutyl-2-ester, mono-2-(2-hydroxyethoxy)ethyl ester, mono-2-hydroxypropyl ester, mono-4-hydroxybutenyl ester, mono-4-hydroxybutyl ester, mono-2-hydroxycyclohexyl ester, mono-4-hydroxycyclohexyl ester and mono-2,3-dihydroxypropyl ester of halophthalic acids, such as 4 (or 5)-fluorophthalic acid, 4 (or 5)-chlorophthalic acid, 4 (or 5)-bromophthalic acid, 3,6 (or 4,5)-difluorophthalic acid, 3,6 or (4,5)-dichlorophthalic acid, 3,6 (or 4,5)-dibromophthalic acid, 3,4,5,6-tetrafluorophthalic acid, 3,4,5,6-tetrachlorophthalic acid, 3,4,5,6-tetrabromophthalic acid and the like. Among the polyvalent metal compounds which form polyvalent metal salts with the above esters, there are included magnesium, calcium, barium, zinc, aluminum, tin, iron, cobalt, nickel and the like. Preferable metals are magnesium, calcium, barium and zinc.

The acceptors as described above may be used either solely or in combination. Among them, benzyl 4-hydroxybenzoate and dimethyl 4-hydroxyphthalate are preferably used, because heat-sensitive record materials which are very superior in adaptability to high speed recording and retainability of the recorded images at high temperature and high humidity and in the white area of which fogging is not substantially appreciated can be obtained with the use of them. Benzyl 4-hydroxybenzoate is most preferably used.

Further, it is preferable to use as the acceptor at least one selected from the group consisting of 4-hydroxydiphenylsulfone derivatives represented by the formula (II), 4-hydroxybenzenesulfonylnaphthalene derivatives represented by the formula (III) or (IV), and polyvalent metal salts of halophthalic acid monoester derivatives represented by the formula (V). With the use of them heat-sensitive record materials which are superior in stability of recorded images and unrecorded white area, and further superior in water resistance and wet plasticizer resistance of the recorded images can be obtained.

Among the above acceptors, there are most preferably used 4-hydroxydiphenylsulfone derivatives represented by the formula (II'),

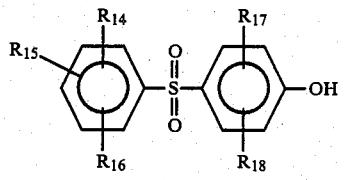

(II')

wherein each of $R_{14}$, $R_{15}$, $R_{16}$, $R_{17}$ and $R_{18}$ radicals is hydrogen, halogen, $C_{1-4}$ saturated or unsaturated alkyl, $C_{1-4}$ alkoxyl or hydroxy, $R_{14}$ and $R_{15}$ or $R_{15}$ and $R_{16}$ may form trimethylene or tetramethylene;

4-hydroxybenzenesulfonylnaphthalene represented by the formula (III') or (IV'),

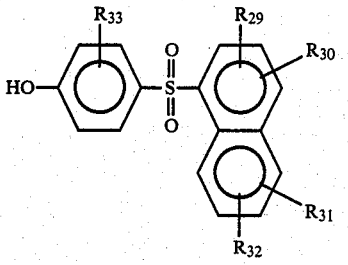

(III')

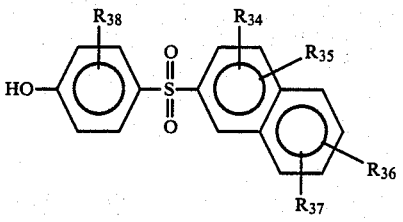

(IV')

wherein each of $R_{29}$ to $R_{38}$ radicals is hydrogen, halogen, $C_{1-4}$ saturated alkyl or $C_{1-4}$ alkoxyl; and polyvalent metal salts of halophthalic acid monoesters represented by the formula (V');

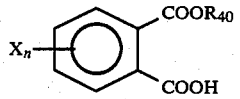

(V')

wherein $R_{40}$ radical is $C_{1-4}$ saturated alkyl which may be substituted by hydroxy group, $C_{1-4}$ unsaturated alkyl which may be substituted by hydroxy group or cyclohexyl which may be substituted by hydroxy group; X is halogen atom; and n is an integer of 1 to 4. Particularly tetrahalo derivatives represented by the formula (V') in which n is 4 are most preferably used.

Most typically, the recording layer may be produced by coating a coating composition including a chromogenic material, an acceptor, a phenol compound represented by the formula (I) and a binder on a base sheet. The ratio of the chromogenic material and the acceptor in the recording layer is not particularly limited. However, the amount of the acceptor is generally within the range of 1 to 20 parts by weight, preferably within the range of 2 to 10 parts by weight, per one part by weight of chromogenic material.

The amount of the phenol compound represented by the formula (I) in the recording layer may be within the range of 1 to 1000 parts by weight, preferably within the range of 10 to 300 parts by weight, per 100 parts by weight of the acceptor.

The method for forming the recording layer is not limited. It may be formed by applying a coating composition on a base sheet. The coating composition may be prepared by dispersing, simultaniously or separately, the chromogenic material, the acceptor and the phenol compound represented by the formula (I) in an aqueous medium with the use of a mixer or pulverizer such as ball mill, attritor, sand mill or the like.

The coating composition usually may comprise a binder in an amount of 2 to 40%, preferably 5 to 25% by weight on the basis of total solid amount. Among the useful binder materials there may be included starches, hydroxyethylcellulose, methylcellulose, carboxymethyl-cellulose, gelatin, casein, gum arabic, polyvinyl alcohol, acetoacetyl-modified polyvinyl alcohol, salts of diisobutylene-maleic anhydride copolymer, salts of styrene-maleic anhydride copolymer, salts of ethylene-acrylic acid copolymer, salts of styrene-acrylic acid copolymer, styrene-butadiene copolymer emulsions, urea resin, melamine resin, amide resin and the like.

The coating composition may include adding materials such as dispersing agents, e.g., sodium dioctylsulfosuccinate, sodium dodecylbenzenesulfonate, sodium lauryl sulfate and metal salts of fatty acids; ultraviolet ray absorbing agents, e.g., triazole compounds; antiforming agent; fluorescent dyes; coloring dyes and the like.

Further, in the coating composition, they may be added zinc stearate; calcium stearate; waxes such as polyethylene wax, carnauba wax, paraffin wax and ester wax; aliphatic amides, e.g., stearic acid amide, stearic acid methylenebisamide, oleic acid amide, palmitic acid amide and coconut aliphatic acid amide; hindered phenols, e.g., 2,2'-methylbenebis(4-methyl-6-tert-butylphenol) and 4,4'-butylidenebis(6-tert-butyl-3-methylphenol); ethers, e.g., 1,2-bisphenoxyethane, 1,2-bis(3-methylphenoxy)ethane, 1,2-bis(4-methylphenoxy)ethan and 2-naphthol benzyl ether; esters, e.g., dibenzyl telephthalate and phenyl 1-hydroxynaphthoate; and inorganic pigments, e.g., kaolin, clay, talc, calcium carbonate, calcined clay, titanium oxide, diatomaceous earth, finely divided silica anhydride and activated clay.

As the base sheets, there are included paper, plastic films, synthetic paper and the like. Paper is most preferably used because of the cost and coating applicability.

There may be applied any conventional coating technique. Generally, the coating composition is coated on a base sheet with an air-knife coator, a blade coator or the like in an amount of 2 to 12 g/m$^2$, preferably 3 to 10 g/m$^2$ on dry basis.

Further, in order to protect the recording layer, an over-coating layer may be formed on the recording layer. If necessary, a protective layer may be formed on the opposite surface of the base sheet. There may be applied under-coating on the base sheet, adhesive agent on the back of the recording material to produce adhesive labels, and the other known techniques in the manufacture of heat-sensitive recording materials.

PREFERRED EMBODIMENTS OF THE INVENTION

The following examples serve to illustrate the invention in more detail although the invention is not limited to the examples. Unless otherwise indicated, parts and % signify parts by weight and % by weight, respectively.

EXAMPLE 1

(1) Preparation of A liquid

The following composition was passed through a sand mill.

| | |
|---|---|
| 1,1,3-tris(2-methyl-4-hydroxy-5-cyclohexylphenyl)butane | 10 parts |
| 5% aqueous solution of methylcellulose | 20 parts |
| water | 10 parts |

Pulverization was continued until an average particle size of 3 μm.

(2) Preparation of B liquid

The following composition was passed through a sand mill.

| | |
|---|---|
| 3-(N—ethyl-N—iso-amyl)amino-6-methyl-7-phenylaminofluoran | 10 parts |
| 5% aqueous solution of methylcellulose | 20 parts |
| water | 10 parts |

Pulverization was continued until an average particle size of 3 μm.

(3) Preparation of C liquid

The following composition was passed through a sand mill.

| | |
|---|---|
| 4,4'-cyclohexylidenediphenol | 45 parts |
| 1,2-bis(3-methylphenoxy)ethane | 35 parts |
| 5% aqueous solution of methylcellulose | 20 parts |
| water | 100 parts |

Pulverization was continued until an average particle size of 3 μm.

(4) Making a heat-sensitive record material

The following composition was mixed to prepare a coating composition.

| | |
|---|---|
| A liquid | 100 parts |
| B liquid | 100 parts |
| C liquid | 200 parts |
| silicone dioxide pigment (oil absorption: 180 ml/100 g) | 30 parts |
| 20% aqueous solution of | 140 parts |

-continued

| | |
|---|---|
| oxidized starch | |
| water | 50 parts |

The coating composition was coated on a base sheet of 50 g/m² in the weight of an amount of 7 g/m² on dry basis to obtain a heat-sensitive record material.

EXAMPLE 2

(1) Preparation of D liquid

The following composition was passed through a sand mill.

| | |
|---|---|
| benzyl 4-hydroxybenzoate | 30 parts |
| 5% aqueous solution of methylcellulose | 10 parts |
| water | 50 parts |

Pulverization was continued until an average particel size of 3 μm.

(2) Making a heat-sensitive record material

Example 1 was repeated except that D liquid was used instead of C liquid to obtain a heat-sensitive record material.

(3) Forming a protective layer 200 parts of kaolin, 200 parts of 20% aqueous solution of oxidized starch and 200 parts of water were mixed to prepare a coating composition. The coating composition was coated on the above record material in the weight of an amount of 3 g/m² on dry basis to obtain a heat-sensitive record material having a protective layer.

EXAMPLE 3

Example 1 was repeated except that 3-dibutylamino-7-(o-chlorophenylamino)fluoran was used instead of 3-(N-ethyl-N-isoamyl)amino-6-methyl-7-phenylaminofluoran in B liquid, the used amount of B liquid was 200 parts and D liquid was used instead of C liquid to obtain a heat-sensitive record material.

EXAMPLE 4

Example 1 was repeated except that C liquid was prepared with use of 4,4'-isopropylidenediphenol instead of 4,4'-cyclohexylidenediphenol to obtain a heat-sensitive record material.

CONTROLS 1 TO 3

Examples 1 to 3 were repeated except that such A liquid was not used to prepare heat-sensitive record materials.

CONTROL 4

Example 4 was repeated except that A liquid was prepared with use of 1,1,3-tris(2-methyl-4-hydroxy-5-tert-butylphenyl)butane instead of 1,1,3-tris(2-methyl-4-hydroxy-5-cyclohexylphenyl)butane to obtain a heat-sensitive record material.

The following properties of thus obtained eight heat-sensitive record materials were examined. The results are shown in Table 1.

(1) Color developability

Each record material was passed through a thermal facsimile (UF-2 type manufactured by Matsusita Denso Kabusiki Kaisha) to develop a color image. The optical density of the color image was measured by Macbeth densitometer.

(2) Heat resistance

The record materials after the above color developing test 1 were allowed to stand at 60° C. under 10% RH and at 70° C. under 10% RH for 24 hours, and then the optical density of the developed color images and the white area without color images was measured in the same manner as in the above test 1.

(3) Moisture resistance

The record materials after the above color developing test 1 were allowed to stand at 40° C. under 90% RH for 24 hours, and then the optical density of the developed color images and the white area without color images was measured in the same manner as in the above test 1.

TABLE 1

| | | Heat Resistance | | | | Moisture Resistance | |
|---|---|---|---|---|---|---|---|
| | | 60° C., 10% RH | | 70°C., 10% RH | | 40°C., 90% RH | |
| | Color Developability | Color Images | White Area | Color Images | White Area | Color Images | White Area |
| Example 1 | 1.20 | 1.14 | 0.11 | 1.09 | 0.13 | 1.19 | 0.13 |
| Example 2 | 1.30 | 1.30 | 0.13 | 1.21 | 0.15 | 1.30 | 0.15 |
| Example 3 | 1.25 | 1.23 | 0.08 | 1.15 | 0.11 | 1.25 | 0.08 |
| Example 4 | 1.32 | 1.30 | 0.08 | 1.26 | 0.13 | 1.32 | 0.10 |
| Control 1 | 1.18 | 1.00 | 0.12 | 0.89 | 0.13 | 0.94 | 0.13 |
| Control 2 | 1.20 | 0.84 | 0.15 | 0.74 | 0.17 | 0.84 | 0.15 |
| Control 3 | 1.10 | 0.66 | 0.08 | 0.54 | 0.10 | 0.66 | 0.08 |
| Control 4 | 1.30 | 1.27 | 0.10 | 1.22 | 0.27 | 1.29 | 0.13 |

As shown in Table 1, each of the heat-sensitive record materials according to the present invention is superior in both of high speed recordability and recorded image retainability and further fogging-free at high temperature and high humidity.

EXAMPLE 5

(1) Preparation of E liquid

The following composition was passed through a sand mill.

| | |
|---|---|
| 3-(N—cyclohexyl-N—methylamino)-6-methyl-7-phenylaminofluoran | 10 parts |
| 5% aqueous solution of methylcellulose | 5 parts |
| water | 40 parts |

Pulverization was continued until an average particle size of 3 μm.

(2) Preparation of F liquid

The following composition was passed through a sand mill.

| | |
|---|---|
| 4-hydroxy-4'-methyldiphenylsulfone | 20 parts |
| 5% aqueous solution of methylcellulose | 5 parts |
| water | 55 parts |

Pulverization was continued until an average particle size of 3 μm.

(3) Preparation of G liquid

The following composition was passed through a sand mill.

| | |
|---|---|
| 1,1,3-tris(2-methyl-4-hydroxy-5-cyclohexylphenyl)butane | 10 parts |
| 5% aqueous solution of methylcellulose | 5 parts |
| water | 40 parts |

Pulverization was continued until an average particle size of 3 μm.

(4) Making a heat-sensitive record material

The following composition was mixed to prepare a coating composition.

| | |
|---|---|
| E liquid | 55 parts |
| F liquid | 80 parts |
| G liquid | 55 parts |
| 15% aqueous solution of polyvinylalcohol | 50 parts |
| calcium carbonate | 10 parts |

The coating composition was coated on a base sheet of 50 g/m$^2$ in the weight of an amount of 6 g/m$^2$ on dry basis to obtain a heat-sensitive record material.

EXAMPLE 6

Example 5 was repeated except that 4-hydroxy-4'-isopropoxydiphenylsulfone was used instead of 4-hydroxy-4'-methyldiphenylsulfone in F liquid to obtain a heat-sensitive record material.

EXAMPLE 7

Example 5 was repeated except that 3',4'-trimethylene-4-hydroxydiphenylsulfone was used instead of 4-hydroxy-4'-methyldiphenylsulfone in F liquid to obtain a heat-sensitive record material.

EXAMPLE 8

Example 5 was repeated except that 2-(4-hydroxybenzenesulfonyl)napthalene was used instead of 4-hydroxy-4'-methyldiphenylslufone in F liquid to obtain a heat-sensitive record material.

CONTROLS 5 TO 8

Examples 5 to 8 were repeated except that each G liquid was not used to obtain heat-sensitive record materials.

The following properties of thus obtained eight heat-sensitive record materials were examined. The results are shown in Table 2.

(1) Whiteness

In order to evaluate fogging, the whiteness of the recording layer of each record materials was measured by Hunter multipurpose reflectometer.

(2) Color developability

Each record material was printed by a thermal printer to develop a color image. The optical density of the color image was measured by Macbeth densitometer RD-100R manufactured by Macbeth Corp.

(3) Water resistance

The record materials after the above color developing test 2 were immersed in water at room temperature for 48 hours, and then the optically density of the developed color image was measured in the same manner as in the above test 2.

(4) Wet plasticizer resistance

The record materials after the above color developing test 2 were slightly moistened with water and the obtained wet record materials were rounded on a roll formed by rounding three times polyvinylchloride film (manufactured by Mitsui Toatsu Kabusiki Kaisha) on a polypropyrene pipe having a diameter of 40 mm, and then the same polyvinylchloride film as used above were further rounded three times on the wet record materials. The resultant roll was allowed to stand for 12 hours at room temperature. The optical density of the color images on the record materials were measured in the same manner as in the above test 2.

TABLE 2

| | Whiteness (%) | Optical density of images | Water Resistance | Wet Plasticizer Resistance |
|---|---|---|---|---|
| Example 5 | 82.5 | 1.40 | 1.18 | 1.08 |
| Example 6 | 82.5 | 1.40 | 1.19 | 1.09 |
| Example 7 | 81.4 | 1.40 | 1.07 | 1.04 |
| Example 8 | 81.0 | 1.35 | 1.10 | 1.13 |
| Control 5 | 83.0 | 1.40 | 0.53 | 0.20 |
| Control 6 | 82.9 | 1.40 | 0.53 | 0.20 |
| Control 7 | 81.6 | 1.38 | 0.40 | 0.24 |
| Control 8 | 81.0 | 1.36 | 0.35 | 0.31 |

EXAMPLE 9

(1) Preparation of H liquid

The following composition was passed through a sand mill.

| | |
|---|---|
| 3-(N—cyclohexyl-N—methylamino)-6-methyl-7-phenylaminofluoran | 10 parts |
| 5% aqueous solution of methylcellulose | 5 parts |
| water | 40 parts |

Pulverization was continued until an average particle size of 3 μm.

(2) Preparation of I liquid

The following composition was passed through a sand mill.

| | |
|---|---|
| zinc salt of 3,4,5,6-tetrachloro-phthalic acid-mono-2-hydroxyethylester | 20 parts |
| 5% aqueous solution of methylcellulose | 5 parts |
| water | 55 parts |

Pulverization was continued until an average particle size of 3 μm.

(3) Preparation of J liquid

The following composition was passed through a sand mill.

| | |
|---|---|
| 1,2-bis(3-methylphenoxy)-ethane | 20 parts |
| 5% aqueous solution of methylcellulose | 5 parts |
| water | 55 parts |

Pulverization was continued until an average particle size of 3 μm.

(4) Preparation of K liquid

The following composition was passed through a sand mill.

| | |
|---|---|
| 1,1,3-tris(2-methyl-4-hydroxy-5-cyclohexylphenyl)butane | 10 parts |
| 5% aqueous solution of methylcellulose | 5 parts |
| water | 40 parts |

Pulverization was continued until an average particle size of 3 μm.

(4) Making a heat-sensitive record material

The following composition was mixed to prepare a coating composition.

| | |
|---|---|
| H liquid | 55 parts |
| I liquid | 80 parts |
| J liquid | 80 parts |
| K liquid | 27 parts |
| 15% aqueous solution of polyvinylalcohol | 50 parts |
| calcium carbonate | 10 parts |

The coating composition was coated on a base sheet of 50 g/m$^2$ in the weight of an amount of 6 g/m$^2$ on dry basis to obtain a heat-sensitive record material.

EXAMPLE 10

Example 9 was repeated except that stearic acid amide was used instead of 1,2-bis(3-methylphenoxy)ethane in J liquid to obtain a heat-sensitive record material.

CONTROLS 9 TO 10

Examples 9 to 10 were repeated that each K liquid was not used to obtain heat-sensitive record materials.

The properties of thus obtained four heat-sensitive record materials were examined in the same manner as in Example 5. The results are shown in Table 3.

TABLE 3

| | Whiteness (%) | Optical density of images | Water Resistance | Wet Plasticizer Resistance |
|---|---|---|---|---|
| Example 9 | 81.0 | 1.25 | 1.13 | 1.06 |
| Example 10 | 81.8 | 1.20 | 1.05 | 1.03 |
| Control 9 | 81.4 | 1.24 | 0.66 | 0.24 |
| Control 10 | 81.6 | 1.20 | 0.50 | 0.21 |

As shown in Tables 2 and 3, each of the heat-sensitive record materials according to the present invention is superior in stability of the recorded images and particularly in improvement of the water resistance and the plasticizer resistance in the wet state. Further, fogging was not appreciated in them.

What we claim is:

1. A heat-sensitive record material having on a base sheet a recording layer which comprises a basic colorless chromogenic material and an acceptor in the state of that the colorless chromogenic material is contacted with the acceptor by heating to produce color images, characterized in that said recording layer further comprises at least one phenol compound represented by the following formula (I),

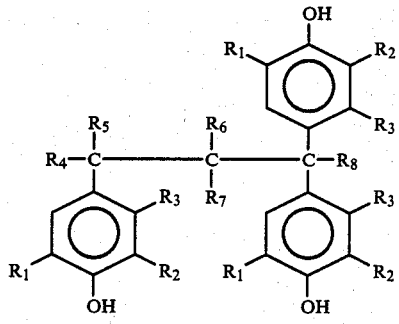

(I)

wherein each of $R_1$, $R_2$ and $R_3$ radicals is hydrogen, $C_{1-8}$ alkyl or $C_{5-8}$ cycloalkyl, but at least one of $R_1$, $R_2$ and $R_3$ radicals is $C_{5-8}$ cycloalkyl; and each of $R_4$, $R_5$, $R_6$, $R_7$ and $R_8$ radicals is hydrogen or $C_{1-8}$ alkyl.

2. A heat-sensitive record material as defined in claim 1, wherein said phenol compound is at least one selected from the group consisting of 1,1,3-tris(2-methyl-4-hydroxy-5-cyclohexylphenyl)butane, 1,1,3-tris(2-ethyl-4-hydroxy-5-cyclohexylphenyl)butane, 1,1,3-tris(2-methyl-4-hydroxy-5-cyclohexylphenyl)propane, 1,1,3-tris(2-methyl-4-hydroxy-5-cyclopentylphenyl)butane, 1,1,3-tris(2-ethyl-4-hydroxy-5-cyclopentylphenyl)butane, and 1,1,3-tris(2-methyl-4-hydroxy-5-cyclopentylphenyl)propane.

3. A heat-sensitive record material as defined in claim 1, wherein benzyl 4-hydroxybenzoate is used as said acceptor.

4. A heat-sensitive record material as defined in claim 1, wherein said acceptor comprises at least one 4-hydroxydiphenylsulfone derivative represented by the following formula (II),

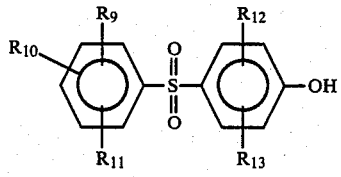

(II)

wherein each of $R_9$, $R_{10}$, $R_{11}$, $R_{12}$ and $R_{13}$ radicals is hydrogen, halogen, $C_{1-10}$ saturated or unsaturated alkyl, $C_{1-10}$ alkoxyl, benzyloxy, aryloxy or hydroxy; and $R_9$ and $R_{10}$ or $R_{10}$ and $R_{11}$ may form trimethylene or tetramethylene.

5. A heat-sensitive record material as defined in claim 4, wherein said 4-hydroxydiphenylsulfone derivative is represented by the following formula (II'),

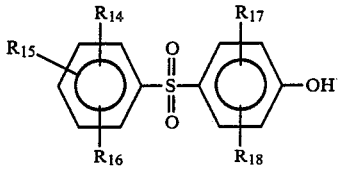

(II')

wherein each of $R_{14}$, $R_{15}$, $R_{16}$, $R_{17}$ and $R_{18}$ radicals is hydrogen, halogen, $C_{1-4}$ saturated or unsaturated alkyl, $C_{1-4}$ alkoxyl or hydroxy; and $R_{14}$ and $R_{15}$ or $R_{15}$ and $R_{16}$ may form trimethylene or tetramethylene.

6. A heat-sensitive record material as defined in claim 1, wherein said acceptor comprises at least one 4-hydroxybenzenesulfonylnapthalene derivative represented by the following formula (III) or (IV),

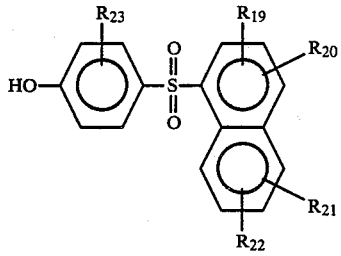

(III)

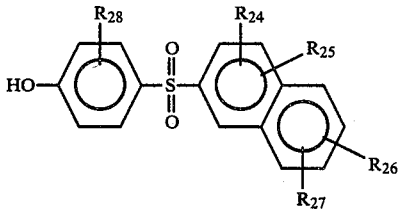

(IV)

wherein each of $R_{19}$ to $R_{28}$ radicals is hydrogen, halogen, $C_{1-10}$ saturated alkyl, $C_{1-10}$ alkoxyl, benzyloxy, aryloxy or hydroxy.

7. A heat-sensitive record material as defined in claim 6, wherein said 4-hydroxybenzenesulfonylnapthalene derivative is represented by the following formula (III') or (IV'),

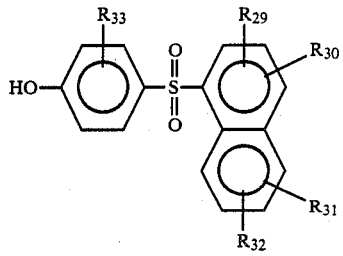

(III')

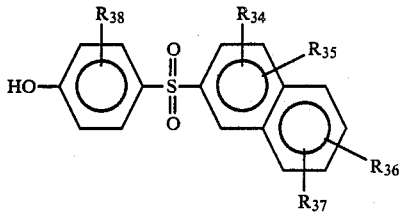

(IV')

wherein each of $R_{29}$ to $R_{38}$ radicals is hydrogen, halogen, $C_{1-4}$ saturated alkyl or $C_{1-4}$ alkoxyl.

8. A heat-sensitive record material as defined in claim 1, wherein said acceptor comprises at least one selected from the polyvalent metal salts of halophthalic acid monoester derivative represented by the following formula (V),

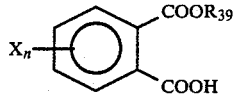

(V)

wherein $R_{39}$ radical is substituted or unsubstituted $C_{1-18}$ saturated alkyl, substituted or unsubstituted $C_{5-6}$ cycloalkyl, substituted or unsubstituted $C_{3-9}$ unsaturated alkyl, substituted or unsubstituted aryl, or substituted or unsubstituted aralkyl; X is halogen; and n is an integer of 1 to 4.

9. A heat-sensitive record material as defined in claim 8, wherein said halophthalic acid monoester derivative is represented by the following formula (V'),

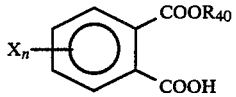

(V')

wherein $R_{40}$ radical is $C_{1-4}$ saturated alkyl which may be substituted by hydroxy, $C_{1-4}$ unsaturated alkyl which may be substituted by hydroxy or cyclohexyl which may be substituted by hydroxy; X is halogen; and n is an integer of 1 to 4.

10. A heat-sensitive record material as defined in claim 8, wherein said polyvalent metal is magnesium, calcium, barium, zinc, aluminum, tin, iron, cobalt or nickel.

11. A heat-sensitive record material as defined in claim 1, wherein a protective layer is formed on said recording layer.

* * * * *

UNITED STATES PATENT AND TRADEMARK OFFICE

CERTIFICATE OF CORRECTION

PATENT NO. : 4,771,033

DATED : September 13, 1988

INVENTOR(S) : Yoshihiro Shimizu et al.

It is certified that error appears in the above-identified patent and that said Letters Patent is hereby corrected as shown below:

Column 15, line 22, "hydroxybenzenesulfonylnapthalene" should read -- hydroxybenzenesulfonylnaphthalene --.

Column 15, line 57, "hydroxybenzenesulfonylnapthalene" should read -- hydroxybenzenesulfonylnaphthalene --.

Signed and Sealed this

Twenty-sixth Day of September, 1989

*Attest:*

DONALD J. QUIGG

*Attesting Officer*

*Commissioner of Patents and Trademarks*